United States Patent [19]

McDonald

[11] Patent Number: 4,552,359

[45] Date of Patent: Nov. 12, 1985

[54] FIXED HAND SPAN DEVICE FOR BOWLER

[76] Inventor: Jerry D. McDonald, 6782 Paul Revere Ct., Orlando, Fla. 32809

[21] Appl. No.: 582,533

[22] Filed: Feb. 22, 1984

[51] Int. Cl.[4] ..... A61B 71/02

[52] U.S. Cl. ..... 273/54 B

[58] Field of Search ..... 273/54 B, 166; 2/161 A; 128/87 A

[56] References Cited

U.S. PATENT DOCUMENTS

| | | | |
|---|---|---|---|
| 3,217,332 | 11/1965 | Gross | 273/54 B |
| 3,398,951 | 8/1968 | Disko | 2/161 A X |
| 3,421,761 | 1/1969 | Grant | 273/54 B |
| 3,563,545 | 2/1971 | Rasche | 273/54 B |
| 4,386,775 | 6/1983 | Kouros | 273/54 B |

*Primary Examiner*—Anton O. Oechsle

*Attorney, Agent, or Firm*—Julian C. Renfro

[57] ABSTRACT

A semi-rigid device utilized on the hand for support in bowling, comprising a generally triangularly shaped member designed for insertion between two fingers of the hand, such as between the index finger and the middle finger, so as to define a consistent spread or span. Securing means are removably attached to the member, with such securing means encircling at least part of the hand or wrist of the user, thus to prevent dislodgement of the generally triangularly shaped member from the selected position between the fingers. I prefer to use a hand-encircling or wrist-encircling strap as the securing means, and I also prefer to use Velcro on the generally triangularly shaped member as well as on the interior portion of the strap in order that proper positioning of the member on the strap may be readily achieved. Additionally, I may utilize two generally triangularly shaped members on occasion, with one of these employed between the index finger and the middle finger, and the other employed between the ring finger and the little finger.

15 Claims, 5 Drawing Figures

FIXED HAND SPAN DEVICE FOR BOWLER

BACKGROUND OF THE INVENTION

In the past, a number of devices have been provided to be worn on the hand of a bowler, so as to help him or her maintain continuous effective control of the bowling ball until the completion of delivery.

Some of these devices have been in the form of a partial glove, so that certain fingers will be grouped together, whereas others are intended to immobilize, or otherwise restrain certain fingers of the blower's hand. However, many of these devices are uncomfortable to such a degree that many blowers will not wear them continuously during an entire match or tournament. Also, many of the finger restraint devices of the prior art have been so bulky or cumbersome as to prevent the wearing of a glove therewith.

However, one of the chief complaints of the prior art has been the erratic performance caused by the poor design of known prior art finger restraint devices.

It was to improve upon such devices that the present invention was evolved.

SUMMARY OF THE INVENTION

Many bowlers fail to remain aware of the location and position of their index finger when their middle and ring fingers, and the thumb of their predominant hand, have been inserted into the holes of a bowling ball. This lack of awareness is unfortunate, because an inconsistency of the position of the index finger may easily bring about an inconsistent roll to the bowling ball, with the consequence that the ball will hook too much, or deflect too much when it hits the pins.

Accordingly, I find it highly desirable to try to help blowers maintain a consistent index finger position, so that they will not cause their ball to hook so much as to fail to hit the desired target or "pocket" between pins 1 and 3, or to deflect so much as to have a bad "split."

Many blowers have realized the importance of the index finger remaining in an optimum and consistent position, but up until now, a consistency in finger position has not been achieved in an effective yet comfortable way.

In a like manner, but to a somewhat lesser extent, it is desirable for the little finger to be kept in a consistent position, for it, too, can adversely affect the roll of the ball, and therefore the blower's score.

Accordingly, I provide aid for the blower in the form of a generally triangularly shaped device that will bring about a proper and suitable spreading between the index finger and the middle finger, which component I choose to call a "sure span" device. As a result of the use of my device, a selected span or spreading can be established between the index finger (ie. the "trigger" finger or forefinger) and the middle finger, or if desired, my novel device may also include means for causing a consistent spread between the ring finger and the little finger.

In extensive tests, I have found that the spreading of the index finger and the middle finger brings about a "late breaking" ball, in which, for a right-handed bowler, the ball travels further down the lane before it hooks to the left. By delaying the hooking of the ball, many bowlers will find that they can hit the pocket more accurately than was previously possible.

Many bowlers are aware that bowling lanes are frequently "dressed", that is, oil is utilized on the wood of the lanes in order to prevent the drying out of the wood. This type of occurence tends to take away part if not all of the hook, which means that the bowler must in effect "point" the ball. In instances of this type, I suggest that the user of my invention employ both of the generally triangularly shaped devices, that is, one between the index finger and middle finger, and the other between the ring finger and the little finger.

In accordance with this invention, I thus provide a semi-rigid device to be utilized on the predominant hand of a bowler, comprising a generally triangularly shaped spacer member designed for insertion between two selected fingers of the hand, such as between the index finger and the middle finger. By "generally triangularly shaped spacer member" I mean to include a device generally of a "V" shape or wedge shape, that will fit between two adjacent fingers of the hand, and extend up to say the first knuckle of the longer finger.

Inasmuch as the bowler typically inserts his or her middle finger, ring finger, and thumb into the holes of a bowling ball, the generally triangularly shaped spacer member will be employed between the index finger and the middle finger to assure a consistent spread therebetween, or in this location plus the location between the ring finger and the little finger. Whichever arrangement the bowler uses, he or she will find that the device in accordance with my invention is highly effective for the purpose intended, inexpensive to produce, and quite comfortable to wear.

Appropriate securing means are utilized for preventing dislodgement of the member, which means can take the form of a strap encircling at least part of the hand or the wrist, with such strap being easily attached or easily released, as may be appropriate at a given time.

The sides of a generally triangularly shaped member are designed to contact the fingers, and in one embodiment, the upper and lower portions of the member may utilize hook and loop fasteners, such as those sold under the trademark Velcro mounted thereon. The aforementioned strap has Velcro on an interior portion thereof to which one portion of the member may be attached. Thereafter, the strap, after encircling at least part of the wearer's hand, is reattachable to the other portion of the generally triangularly shaped member, so that such member will be retained against dislodgment from the position between the selected fingers.

A further embodiment utilizing the generally triangularly shaped member in accordance with this invention involves an elongate support member used therewith that is designed to be supported from the wrist area of the user, and to extend along the back of the hand to a location adjacent the base of the fingers. The upper portion of the generally triangularly shaped member has Velcro mounted thereon, and the elongate support member has Velcro on an interior portion, adjacent the base of the fingers. As a result, the Velcro of my generally triangularly shaped member may removably attach to the elongate support member, thus to be supported in a selected position between the fingers. A strap may optionally be attached to the support member, to encircle a portion of the fingers.

A single generally triangularly shaped spacer member may be utilized between the index finger and the middle finger, or a pair of generally triangularly shaped spacer members can be utilized, with one used in the aforementioned location, and the other utilized between the ring finger and the little finger.

Advantageously, I use one type of Velcro, such as the hook or "male" type, either on the top of the triangularly shaped spacer member, or top and bottom of such member. Then, the other type, Velcro, i.e. the eyelet or "female" type, is used on the finger-encircling or hand-encircling strap employed with my spacer members. In that way, I extend to the bowler a substantial amount of versatility, so that he or she can maintain the spacer or spacers in the chosen locations, and can readily adapt the strap to fit his or her hand, so that the spacers will not be dislodged, and so that comfort can at all times be secured.

Typically the type of Velcro used on my generally triangularly shaped members is of the "male" type, whereas the interior portion of the strap or support member to be used with the generally triangularly shaped members is of the "female" type, wherein a large number of tiny eyelets are made available, and into which the hook members of the "male" type Velcro may be inserted.

Also, I make possible the use of a variety of supporting members usable by the bowler in connection with the triangularly shaped members, such that comfort and servicability will at all times be secured.

It is therefore a principal object of my invention to provide a bowling aid for the hand of a bowler, which will comfortably and effectively establish a fixed span between two of his or her fingers.

It is another object of my invention to provide a bowling aid of inexpensive construction that will enable the bowler to make consistent and effective use of his forefinger, and optionally his little finger, at the time of rolling the ball.

It is yet another object of my invention to provide a versatile device that will assure a comfortable and consistent spacing of the fingers during bowling, that will help many bowlers to substantially improve their score.

These and other objects, features and advantages will become more apparent as the description proceeds.

DETAILED DESCRIPTION

Figure 1:
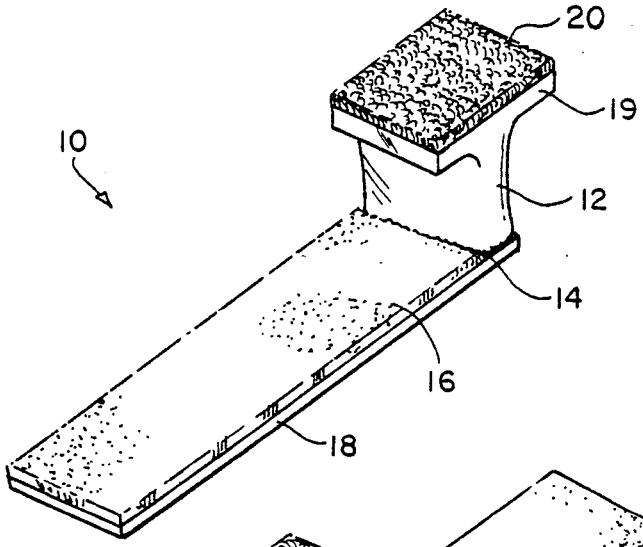
FIG. 1 is a perspective view of a basic form of my device, involving a single generally triangularly shaped member, which is to be attached adjacent one end of a strap provided with Velcro.

Turning to FIG. 1, it will there be seen that the sure span device 10 in accordance with this invention involves a generally triangularly shaped member 12, on the bottom or lower portion of which is provided one portion 14 of a hook and loop fastener, such as is sold under the trademark Velcro, such that it will engage the other portion 16 of the hook and loop fastener on the upper (inner) portion of the associated strap 18. In this embodiment I utilize a generally rectangular upper portion 19 on the triangularly shaped member 12, which is covered with Velcro 20.

This particular embodiment of my invention is of such a nature as to be utilized between the index finger (ie. trigger finger or forefinger) and the middle finger of a right handed bowler, with it to be understood that the strap 18 is encircled about the index finger of the bowler when the device is about to be utilized. In this instance, the strap is brought over on top of the fingers, such that the Velcro 16 in the interior surface of the strap can be installed in contact with the Velcro 20 on the upper portion of the generally triangularly shaped member 12. As is obvious, the bowler may make the strap tighter or looser, as may meet his or her individual preferences. Also, it is to be noted that this device does not inhibit the bowler from also wearing a conventional bowler's glove on the same hand.

Quite clearly a left handed bowler can use the device of FIG. 1 by moving the generally triangularly shaped member to the opposite end of the strap, and placing it in firm contact there with the Velcro 16.

Figure 2:
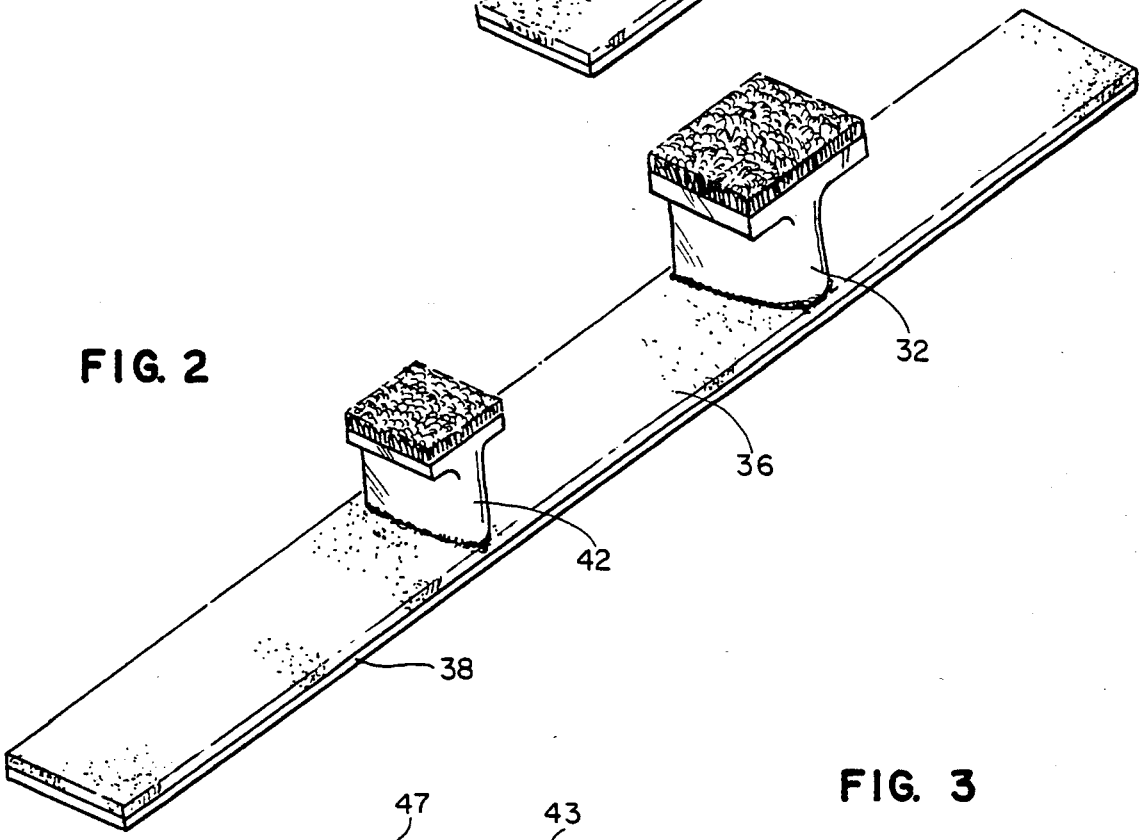
FIG. 2 is a device generally like that shown in FIG. 1, but here utilizing a longer strap, such that a second generally triangularly shaped member can also be mounted thereon.

In FIG. 2, I show an arrangment involving the use of a longer strap 38, which is provided with Velcro 36 for substantially its entire length. I typically prefer to use "female" or eyelet Velcro on the strap, and to use "male" or hook type Velcro on the upper and lower portions of the generally triangularly shaped members, but I am not to be limited to this.

The arrangement shown in FIG. 2 is such as may be used by a left-handed bowler, wherein the triangularly shaped member 32 is to be utilized between the index finger and the middle finger, and the somewhat smaller triangularly shaped member 42 is utilized between the ring finger and the little finger. Velcro is used both top and bottom of the triangular members 32 and 42, so the bowler can readily move either or both devices so as to select the spacing of the triangularly shaped members appropriate for his or her particular hand. Also, the bowler can select from several sizes of generally triangularly shaped members, those members that are most comfortable for his or her hand. Upon the generally triangularly shaped members being properly placed, the ends of the strap 38 can be placed around the fingers and into contact with the Velcro at the opposite ends of members 32 and 42, so as to secure these members in the proper relationship.

A right handed bowler would typically swap the positions of the members 32 and 42, so as to place the larger member 32 between the index finger and the middle finger of his or her right hand.

Figure 3:
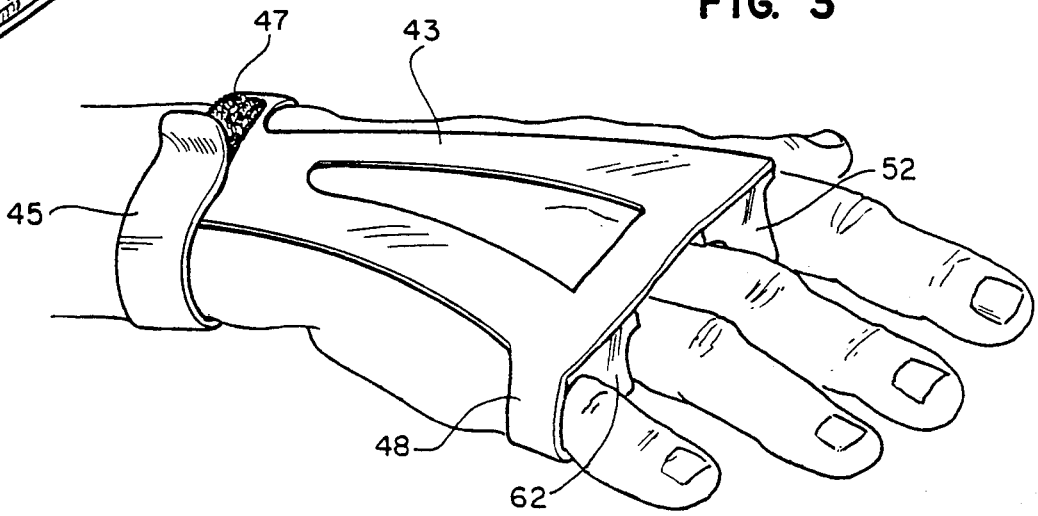
FIG. 3 is a showing of a typical bowler's hand, revealing the use of a support member on the back of the hand serving with the assistance of an encircling strap to maintain one or two triangularly shaped spacer members in an appropriate position.

Turning now to FIG. 3, it will there be seen that I show an arrangement in which I utilize an elongate support device 43 extending across the back of the hand from the wrist to the finger area, so as to assist in maintaining the generally triangularly shaped members, such as members 52 and 62 generally corresponding to members 32 and 42, in the appropriate relationships to the bowler's hand.

Velcro is provided on the underside of the support device 43 in a location remote from the wrist, so that the members 52 and 62 will be effectively maintained in the selected locations. However, I additionally configure the elongate support member 43 so as to have a strap (not shown) encircling the index finger, and a strap 48 encircling the little finger. Separate straps can be used in this instance, or a single strap employed to maintain proper control of the positioning of the generally triangularly shaped members. Velcro is used on the interior portion of the strap or straps, which are affixed to the other ends (not shown) of the generally triangularly shaped members 52 and 62, in the same general manner as explained with respect to members 32 and 42.

With continued reference to FIG. 3, it will be noted that the elongate support member 43 is maintained in the proper relationship to the back of the bowler's hand by the use of an integral wrist-encircling strap 45, which utilizes Velcro in order that the bowler can make the strap as tight or as loose as he or she finds to be both comfortable and effective. Typically, male Velcro is used at location 47, and female Velcro is used near the end of the strap.

Figure 4:
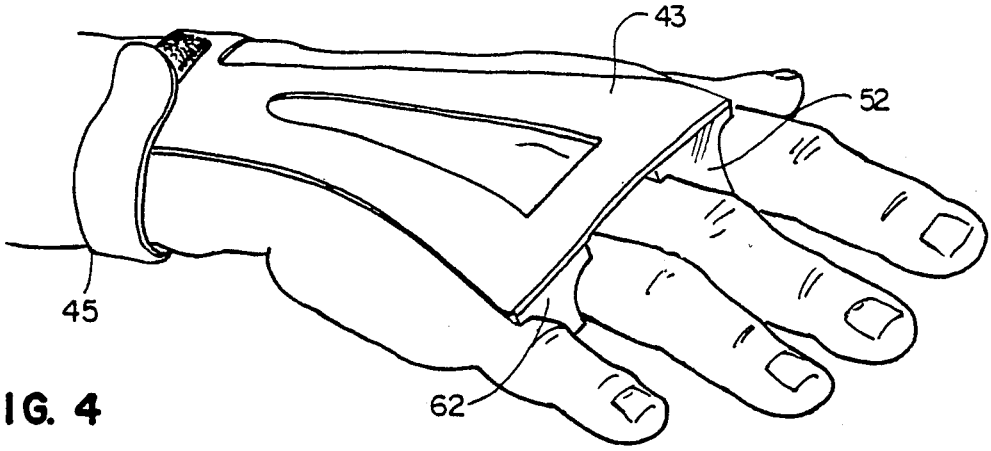
FIG. 4 is a view quite similar to FIG. 3, but revealing that the triangularly shaped spacer members may be utilized on the support member without a strap encircling the fingers.

Turning to FIG. 4, it will there be seen that I have shown a device quite similar to the device 43 depicted in FIG. 3, except that omitted are the finger-encircling straps, such as the strap 48.

As can be seen in FIGS. 3 and 4, the generally triangularly shaped members are sized to be inserted between two adjacent fingers of the hand. Note especially the extent of element 62 relative to the finger thickness in both of these Figures.

Figure 5:
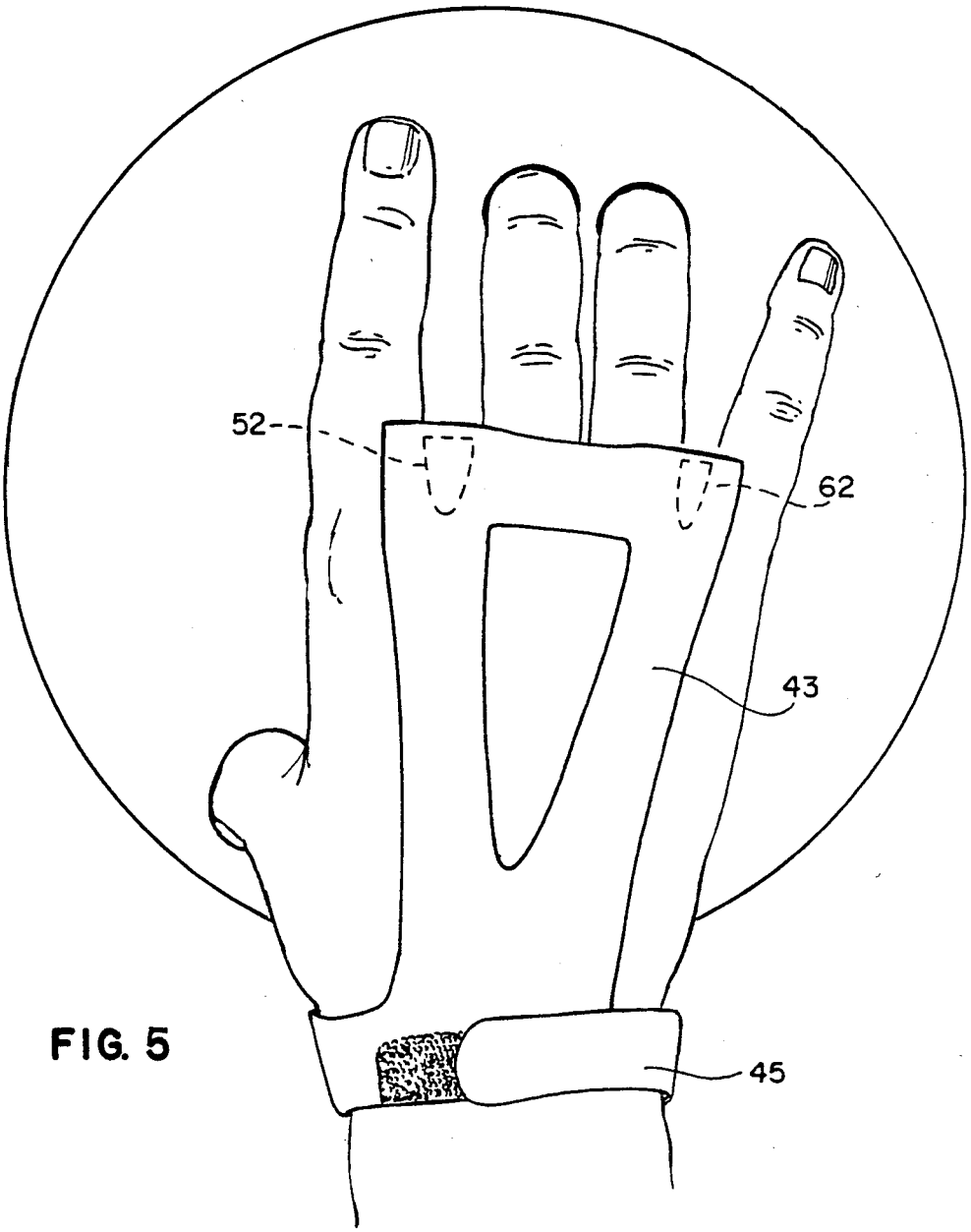
FIG. 5 is a top view of the bowler's hand shown in connection with a bowling ball, with this view serving to show the spreading effect a pair of generally triangularly shaped members in accordance with this invention have upon the positions of the bowler's fingers.

In FIG. 5 I have shown a device in the nature of that shown in FIG. 4, except that in this instance the bowler's hand is shown in its relationship to a bowling bowl. Although I could have an additional strap encircling the fingers or a strap encircling the palm of the hand, I prefer to merely rely in this embodiment upon the wrist strap 45 maintaining the generally triangularly shaped members 52 and 62 in the appropriate relationship. As is obvious, the elongate support member 43 will need to be of relatively stiff construction, so that the generally triangularly shaped members will tend to stay in the appropriate locations during use. An advantage of the construction I use is that the bowler can readily move aside the resilient member and the generally triangularly shaped members removably attached thereto, should he or she decide in a particular instance to dispense for the moment with the use of the generally triangularly shaped members.

My generally triangularly shaped members can be made of rubber, plastic, urethane, or any other semi-rigid material that will retain its shape and be comfortable in its contact with the fingers of the user. The elongate support member 43 can be made of leather, plastic, heavy cloth with or without a coating, or other such material that possesses desired qualities of resilience and flexibility.

Rather than limit the bowler to selecting between only a very few, limited sizes of generally triangularly shaped members, I prefer to have each dealer trace the configuration of each bowler's hand, and then fit the bowler with members that are sized appropriately for him or her, taking height, angle, rigidity, and other such considerations for the triangular member into account. Hand measurements are preferably taken on a piece of paper (or plastic) slipped between the bowler's hand and the ball, while the bowler is grasping the ball in the manner typical or appropriate for him or her, as the ball is about to be delivered.

It is to be realized that my sure-span device is not limited to use by bowlers, for my device can be used by participants of other sports or events in which an object is grasped, hit, or contained in the hand.

I claim:

1. A semi-rigid device utilized on the hand for support in bowling, comprising a generally triangularly shaped member designed for insertion entirely between two fingers of the hand, and securing means attached to said member, said securing means encircling at least part of the hand or wrist of the user, for preventing dislodgement of said member from the selected position between the fingers.

2. The semi-rigid device as recited in claim 1 in which a hook and loop fastener is attached to said member, and said securing means takes the form of a strap equipped on its interior portion with another type of hook and loop fastener, which strap is readily releasable from the hand or wrist at the behest of the user.

3. The semi-rigid device as recited in claim 2 in which at least one end of said generally triangularly shaped member is fitted with said hook and loop fastener, so that it may be readily attached to or released from said strap.

4. The semi-rigid device as recited in claim 2 in which said strap is long enough to encircle the user's hand, and two of said generally triangularly shaped members are releasably mounted thereon by the user of hook and loop fasteners, said members being spaced apart sufficienty that one member can be used between the index finger and the middle finger, and the other member can be used between the ring finger and the little finger.

5. The semi-rigid device as recited in claim 2 in which both ends of said generally triangularly shaped member are fitted with a hook and loop fastener, such that said strap can be attached to one end of said generally triangularly shaped member, encircled about part of the hand, and then attached to the other end of said generally triangularly shaped member.

6. The semi-rigid device as recited in claim 1 in which said securing means takes the form of an elongate support member supported from the wrist area, and then extending across the back of the user's hand to the base of the fingers, and to an interior part of which member, at least one said generally triangularly shaped member is removably attached.

7. The semi-rigid device as defined in claim 6 in which a second generally triangularly shaped member is also utilized on said support member, said second generally triangularly shaped member being so located on said support member as to be insertable between a second pair of fingers of the bowler's hand.

8. A semi-rigid device utilized on the hand for support in bowling, comprising a generally triangularly shaped member designed for insertion entirely between two fingers of the hand, and a strap used therewith designed to encircle at least part of a wearer's hand or wrist, the sides of said triangular member being designed to contact the fingers, and the upper and lower portions of said triangular member having a hook and loop fastener mounted thereon, said strap having a hook and loop fastener on an interior portion therof to which one portion of said triangular member may be attached, said strap, after encircling at least part of the wearer's hand, being reattachable to the other portion of said triangular member, so that latter member will be retained against dislodgment from the position between the fingers.

9. The semi-rigid device as defined in claim 8 in which an additional hook and loop fastener is utilized on said strap, such that fastening to the hand or wrist of the wearer, as well as release therefrom may be readily accomplished.

10. The semi-rigid device as defined in claim 8 in which a second generally triangularly shaped member is utilized on said strap, said latter member to be inserted between a second pair of fingers of the bowler's hand.

11. The semi-rigid device as defined in claim 8 in which said strap is supported from an elongate member extending across the back of the hand of the wearer.

12. A semi-rigid device utilized on the hand for support in bowling, comprising a generally triangularly shaped member designed for insertion entirely between two fingers of the hand, and a support member used therewith designed to be supported from the wrist area of the user, and to extend along the back of the hand to a location adjacent the base of the fingers, the sides of said generally triangularly shaped member being designed to contact the fingers, and the upper portion of said member having a hook and loop fastener mounted thereon, said support member having a hook and loop fastener on an interior portion thereof adjacent the base of the fingers, to which the hook and loop fastener of said generally triangularly shaped member may attach, thus to be supported in a selected position between the fingers.

13. The semi-rigid device as recited in claim 12 in which two of said generally triangularly shaped members are utilized, each fitted with a hook and loop fastener on its upper portion, and intended to be utilized between different pairs of fingers, each of said generally triangularly shaped members being mounted upon the hoop and loop fastener of said support member adjacent the base of the fingers.

14. The semi-rigid device as recited in claim 12 in which a strap is affixed to said support member adjacent the base of the fingers, which strap can encircle a portion of the hand, and thereby stably hold said generally triangularly shaped member against dislodgment.

15. The semi-rigid device as defined in claim 14 in which a hook and loop fastener is utilized on both ends of at least one of said generally triangularly shaped members as well as on an inner portion of said strap, such that said at least one generally triangular shaped member can be readily attached to said strap, as well as readily released therefrom.

* * * * *